United States Patent [19]

Towfigh

[11] Patent Number: 4,791,873

[45] Date of Patent: Dec. 20, 1988

[54] MULTIPURPOSE ADJUSTABLE DESK-TOP

[76] Inventor: Keivan Towfigh, 14 Felton St., Waltham, Mass. 02154

[21] Appl. No.: 512,188

[22] Filed: Jul. 11, 1983

Related U.S. Application Data

[63] Continuation of Ser. No. 223,804 Jan. 9, 1981.

[51] Int. Cl.[4] ..... A47F 5/12

[52] U.S. Cl. ..... 108/10; 108/39; 108/134

[58] Field of Search ..... 108/10, 39, 40, 48, 108/38, 134

[56] References Cited

U.S. PATENT DOCUMENTS

| | | | |
|---|---|---|---|
| 1,568,376 | 1/1926 | Grant | 108/39 |
| 2,843,436 | 7/1958 | Franks | 108/134 |
| 2,916,339 | 12/1959 | Zobac | 108/134 |
| 3,026,158 | 5/1962 | Freeman | 108/10 |
| 3,151,576 | 10/1964 | Patterson | 108/6 |
| 3,865,337 | 2/1975 | Towfigh et al. | 248/246 |

*Primary Examiner*—Francis K. Zugel

*Attorney, Agent, or Firm*—Wolf, Greenfield & Sacks

[57] ABSTRACT

A multi-purpose retractable desk or table top is provided for use in conjunction with a shelving or wall system. The system includes vertical standards having channels which typically are receptive to shelf brackets. The retractable desk top is attached to the standards by a linkage and mechanism which enables the top to be infinitely oriented at any angle from horizontal to vertical. In its vertical, retracted configuration, the desk top lies substantially flat against the standards and the linkage is substantially concealed within the standards. The attachment linkage and mechanism is constructed to enable the height of the entire device to be adjusted.

8 Claims, 2 Drawing Sheets

MULTIPURPOSE ADJUSTABLE DESK-TOP

This is a continuation of Ser. No. 223,804, filed Jan. 9, 1981.

BACKGROUND AND SUMMARY OF THE INVENTION

This invention relates to a table-like surface such as a desk top, drawing board or the like which is infinitely adjustable to any position between a retracted vertical position and a horizontal table-like position. The invention is intended to be used in conjunction with shelving or wall systems and particularly, the type of shelving or wall system which uses vertical standards. to which shelving brackets are attached. The present invention is particularly useful in areas where space is limited and where it is desirable to have, selectively, a table, desk, drawing board or similar work surface which can be easily folded away into a flat stored position yet which is very stable, strong and easy to use. For example, used in combination with shelving system, the invention results in a most convenient work or study center.

In brief, the present invention includes the vertical standards of the type used in conjunction with shelving systems. The standards may be secured directly to a wall or may be of the free-standing type which are secured to the floor and to a ceiling member, and in which shelving or similar brackets may be supported on and protrude from the standard in a number of different directions. The desk top is attached to a linkage which in turn, is mounted to the standards in a manner which enables the entire device to be adjustably raised or lowered as well as to enable its angular attitude to be adjusted from a horizontal table-like configuration to a vertical stored configuration. In its retracted configuration, the desk top lies vertically and closely against the standards and is concealed within the standards and behind the desk top.

The linkage includes slideable members which are guided in the standards. The members may be locked in any position in the standards. The linkage includes a pair of support linkages each of which includes a pair of links. The links in each pair are connected pivotally to each other at one end and at their other end to a vertically moveable yoke, which is slideably received in the channel of the vertical standard. Means are provided for releasably locking each unit in a desired position on the standards which varies the attitude of the links. The board is secured to the upper link in each linkage pair so as to move with the linkage pairs.

It is among the general objects of the invention to provide an infinitely adjustable retractable desk top surface which is useable in conjunction with a shelving system or by itself.

Another object of the invention is to provide a system and device of the type described which is infinitely adjustable both as to height and as to attitude.

Another object of the invention is to provide a device of the type described which may be stored in a retracted, vertical configuration which occupies minimal space.

A further object of the invention is to provide a device of the type described which may be used for many purposes such as a desk top, drafting table, artist's easel or projection screen.

Another object of the invention is to provide a device of the type described which is useable in conjunction with a shelving system having vertical standards to which shelves, lights and other items may be mounted.

A further object of the invention is to provide a device of the type described which achieves the foregoing objects yet which is stiff, sturdy and stable in all positions.

Another object of the invention is to provide a device of the type described in which the linkages fold away into the vertical channel when the device is in its stored configuration.

A further object of the invention is to provide a device of the type described which is easily assembled and disassembled.

DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATIVE EMBODIMENT

Figure 3:
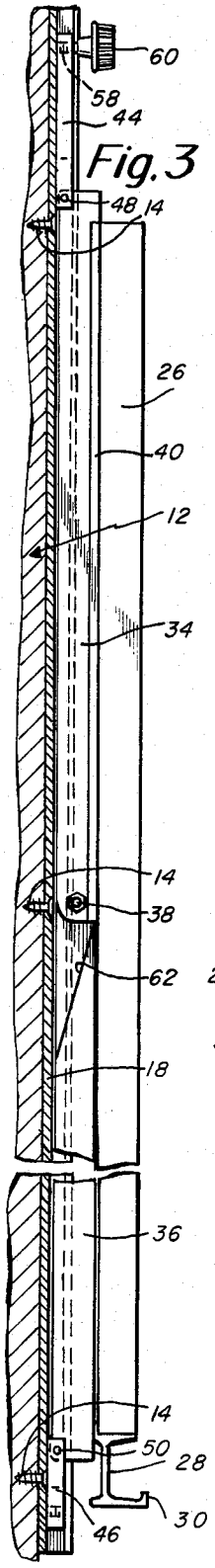
FIG. 3 is a side elevation of the device in its vertical, fully-retracted configuration.

The illustrative embodiment of the invention is in the form of a wall-mounted version of the device in which vertical standards 10 are secured to a primary support means, such as a wall 12 by screws 14 or the like (FIG. 3). The standards 10 may be formed from an appropriate material such as extruded aluminum and have a cross section which defines a channel 15 extending fully along the length of the standard 10. The channel is defined by a rear wall 18, a pair of side walls 20 and a pair of inwardly-extending flanges 22, the inner edges 24 of which define a longitudinally extending slot (see FIG. 5). The screws 14 preferably are countersunk in the rear wall 18 of the standard so that the forwardly-facing inner surface of the rear wall 18 presents a smooth, planar surface. Standards of this type may be used in conjunction with the type of shelving bracket illustrated in U.S. Pat. No. 3,865,337.

Figure 1:
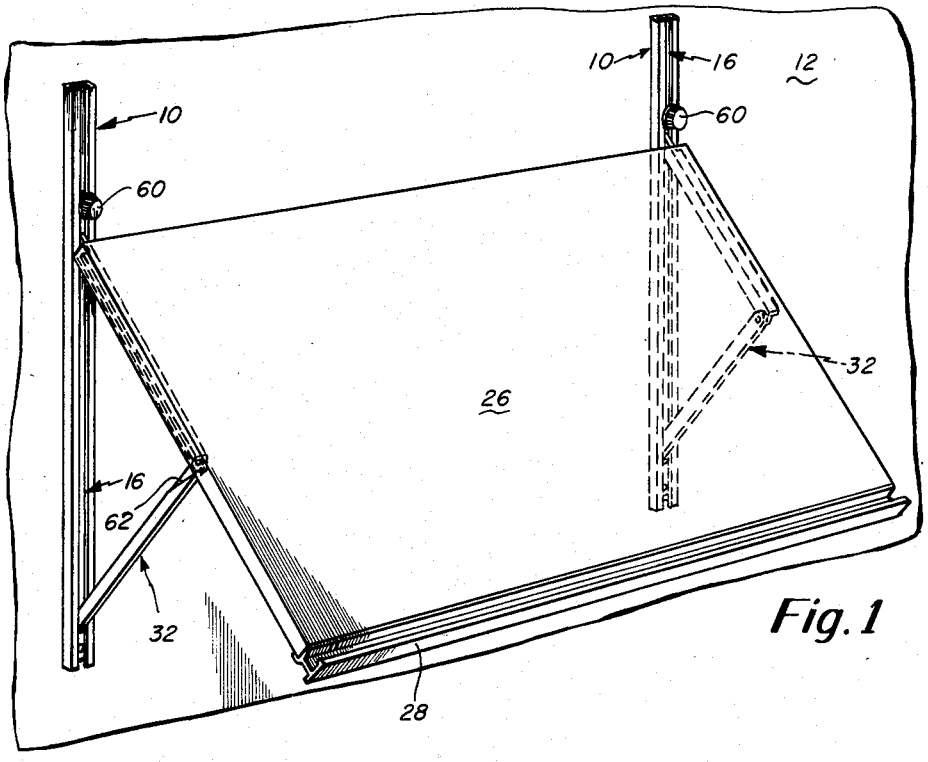
FIG. 1 is an illustration of the device in a wall-mounted configuration, with the board in an intermediate configuration.
Figure 2:
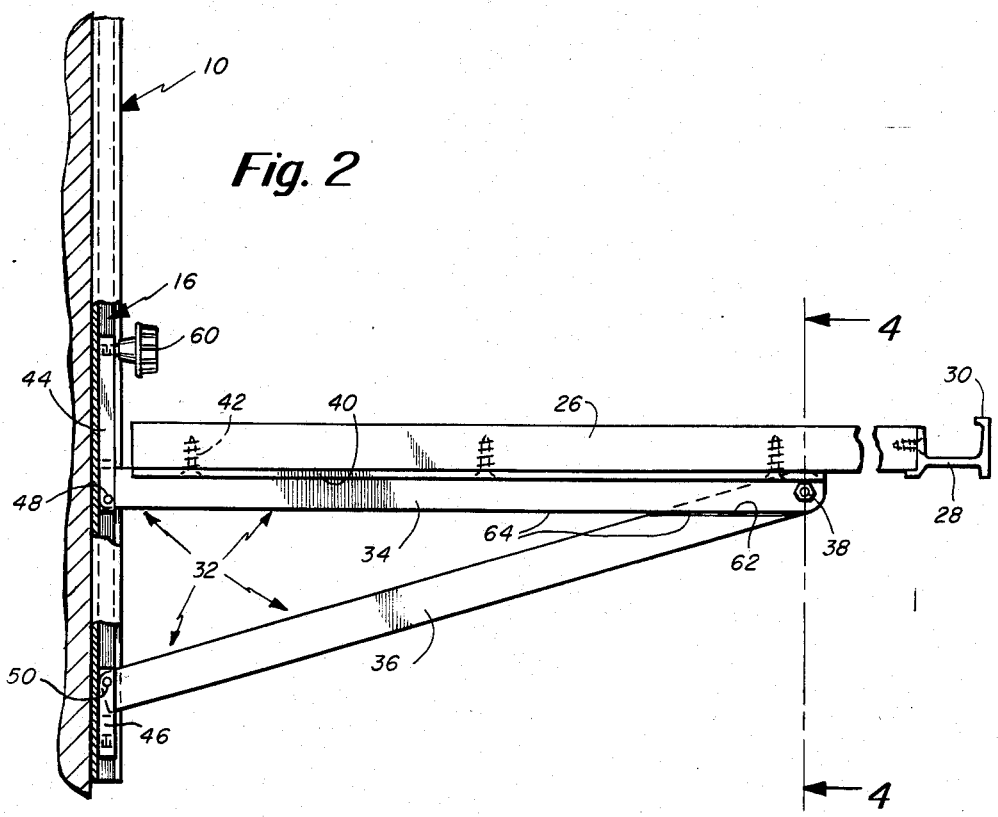
FIG. 2 is a side elevation, partly broken away, of the board in a horizontal, fully-extended configuration for use as a desk-top.

As shown in FIGS. 1–3, the present invention includes a board indicated generally at 26. The board 26 preferably is provided at its front edge with a channel-shaped member 28 which may serve to hold pens or other items as desired by the user. The member 28 preferably includes a lip 30 which extends slightly above the working surface of the board 26 so that the board may support paper sheets or the like when the board is in its intermediate configuration as illustrated in FIG. 1 or in an even more vertical attitude, for use as an easel.

The board 26 is mounted to a pair of linkages, indicated generally at 32 which support the board 26 for movement betweeen its flat horizontal and extended position illustrated in FIG. 2 to its fully-retracted, vertical position illustrated in FIG. 3, and to any intermediate, infinitely selected position in between (such as in FIG. 1). Each linkage 32 includes an upper link 34 and a lower link 36. The forward end of the upper and lower links 34, 36 are pivoted together at a common pivot 38. As will be described in more detail below, the rearward ends of each of the upper and lower links 34, 36 are pivoted to yokes which are slidably moveable within the vertical channels 16 of the standards 10. Each of the upper links 34 is angle shaped (in cross section) to define a mounting flange 40 to which the board 26 is secured as by screws 42. As illustrated in FIG. 1, it is preferred to attach the upper links 34 to the board 25 in proximity to the side edges of the board 26.

Figure 4:
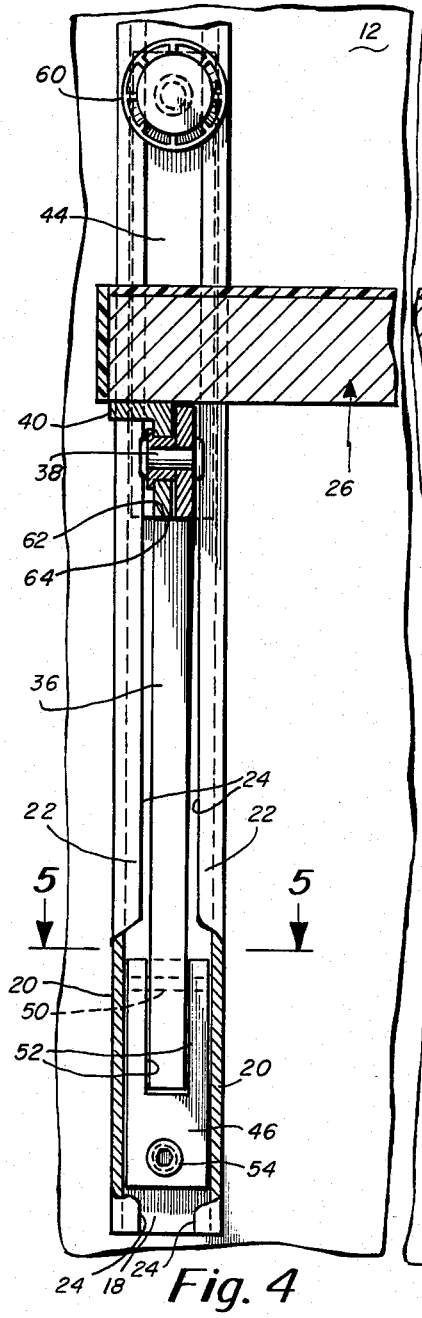
FIG. 4 is a sectional illustration of a portion of the device as seen along the line 4—4 of FIG. 2.
Figure 4A:
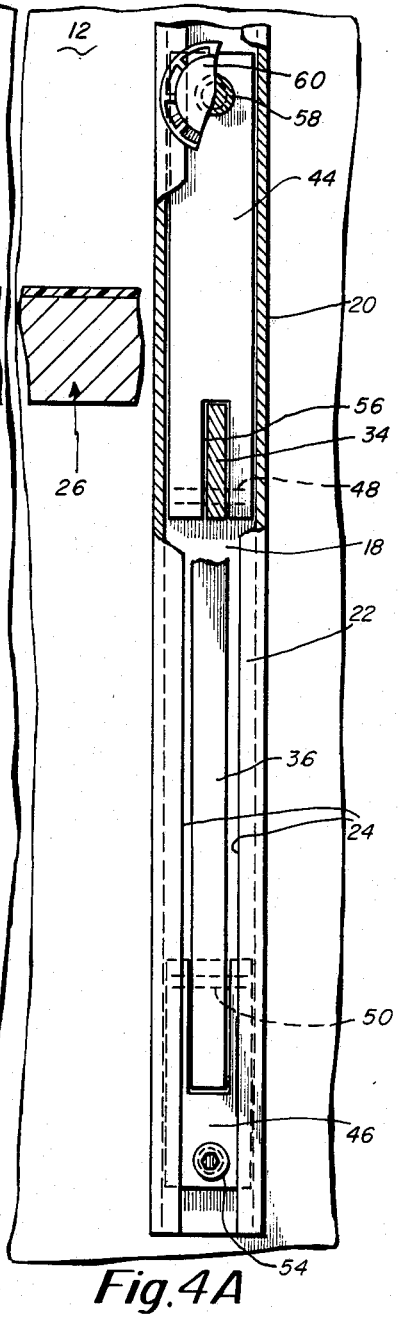
FIG. 4A is an illustration similar to FIG. 4, but further broken away to illustrate the upper yoke construction.
Figure 5:
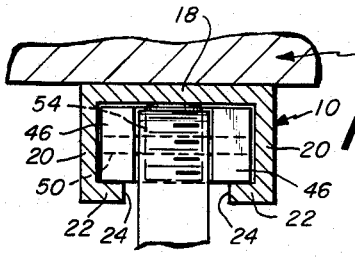
FIG. 5 is a sectional illustration of the standard and mounting for the lower yoke as seen along the line 5—5 of FIG. 4.

The inner ends of the upper link and the lower link 34, 36 of each linkage 32, are attached to an upper yoke 44 and a lower yoke 46, respectively, by means of pivot pins 48, 50. Each of the upper and lower yokes 44, 46 is of cross-sectional dimensions so as to be received in a close but slideable fit within the channel 16 of the standard 10, means being provided to secure each of the yokes in a selected position in each channel, as descried more fully below. The lower yoke 48, as illustrated in FIGS. 4 and 5, includes an upwardly opening slot 52 which receives the rearward end of the lower link 36, the pivot pin 50 extending through the upper end of the yoke 46 and rear end of the link 36. The connection between the lower yoke 46 and lower link 36 is such as to enable the lower link 36 to pivot fully and freely between a vertical position illustrated in FIG. 3 and a nearly horizontal position as illustrated in FIG. 2.

The position of the lower yoke 46 may be adjusted to any height along the standard 10. The position of the lower yoke 46 is secured by a set screw 54 which is threaded through the yoke 46 and may be tightened to bear against the rear wall 18 of the standard 10. The set screw 54 is tightened sufficiently to cause the forwardly-facing surface of the lower yoke 46 to bear firmly against the rearwardly-facing surfaces of the flanges 22 on the standard 10. Usually, once the position of the lower yoke has been selected in a particular installation, there will be no further need for it to be changed, and it may remain in place. Therefore, it is preferred to utilize a set screw of the type illustrated, having a head which does not project outwardly beyond the confines of the channel and preferably includes a recess such as the allen type of socket shown.

The upper yoke 44 includes a downwardly-opening slot 56 which receives the rear end of the upper link 34 and the pivot pin 48. The slot 56, upper link 34 and pin 48 are arranged to provide full range of free movement to enable the upper link 34 to move between the vertical configuration shown in FIG. 3 and the horizontal configuration shown in FIG. 2, as well as to any intermediate position such as illustrated in FIG. 1. The upper yoke 44 also is slideable within the channel 16. The upper yoke 44 is relatively long so that it has an upper end which will extend, at all times, above the region where the yoke 44 is connected to the rear end of the upper link 34. The upper end of the upper yoke 44 is provided with a manually tightenable set screw 58 which extends forwardly through the longitudinal slot in the standard 10 where the screws 58 are attached to knobs 60. The knobs 60 are exposed at all times and are located above the upper links 34 and above the table surface 26. The protruding manually operated knobs 60 provide a readily available means by which the set screws 58 associated with the upper yokes 44 may be tightened or loosened when adjusting the desired position of the board. The knobs 60 also provide a convenient means by which to adjustably raise or lower the rear end of the board, thereby varying its angular attitude. The action is very simple, precise and quick.

The manner is which the forwardly extending ends of the upper and lower links 34, 36 are connected together provides a number of advantages relating to the stability, positioning and compact retractability of the system. As shown in FIGS. 1, 2 and 4, the lower link 36 is formed, at its forward end, with a cut-away portion which defines a horizontally-extending shoulder 62. The cut-away is formed so that the shoulders 62 will extend an oblique angle (with respect to the length of the lower link 36. The angle is selected so that it also will define a horizontal surface when the linkage is in its lowered, fully horizontal position.) For example, I have found that forming the shoulder 62 at approximately an angle of about 15 degrees with respect to the longitudinal dimension of the lower link 36 provides quite good results. The shoulder 62 is located wtih respect to the common pivot 38 and the upper link 34 so that when the upper link is in its horizontal position, the lower edge 64 of the upper link 34 will bear and rest on the shoulder 62. This provides an enhanced support to the system when it is in its horizontal configuration and also provides a clear indication to the user when the table has been lowered to is horizontal position, because engagement of the lower edge 64 of the upper link 34 with the shoulder 62 defines the lower limit of the linkage.

As described above, when the device is raised to its vertical, retracted configuration the board lies vertically in proximity to the standards, thereby occupying minimal space which enhances the desirability of the present invention for use in areas where space is at a premium. As shown, the thickness of the lower link 36 is less than the width of the slot in the forward face of the standard, as defined by the edges 24. The upper link 34, however, is of less thickness and is selected to be of a thickness equal to the width of the shoulder 62 (See FIG. 4). Thus, no portion of the overlapping end portions of the upper and lower links 34, 36 will be greater in combined thickness than the width of the forwardly-facing slot in the standard 10 so that when the device is raised to its vertical configuration (FIG. 3) both the upper and lower links 34, 36 will be received within the channel 16 of the standard and in the extended position shown. The upper link 34 is not reeuced in strength because of its angled configuration which includes the mounting flange 40. Thus, although thinner than the lower link 36, the upper link 34 is quite strong, yet is of a construction which enables it and the lower link 36 to assume a vertical, aligned and extended configuration which is receivable in the standard 10 as shown in FIG. 3. It may be noted that it is preferred to select the lengths for the links with respect to the size of the board 26 so that when the device is in its vertical position shown in FIG. 3 the board 26 will overlap and conceal the linkage members, thus presenting a clean appearance.

From the foregoing it will be appreciated that the present invention is very useful in a wide variety of environments, particularly where the multi-use type of board, desk, easel projection screen or the like is desired. It is suited particularly in environments where space is a premium, such as in small apartments, offices or the like, although its use is not necessarily restricted to those environments. It may be used in conjunction with shelving systems. The standards illustrated in FIGS. 1–3 thus may be considerably longer than those illustrated and may receive a number of shelving brackets of the type described in U.S. Pat. No. 3,865,337 in which various shelving arrangements, incorporating the present invention, may be used to define a work or study center.

It should be understood, however, that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A retractable work surface system comprising:

a pair of vertically-extending, laterally spaced elongate standards, each standard defining a longitudinal channel having a rear wall, a pair of spaced sidewalls extending forwardly from the rear wall, said channel having a forwardly facing restricted opening formed along its length and at the forward region thereof, the restricted opening being defined by a pair of flanges extending inwardly toward each other from the forward end of the sidewalls;

means enabling each standard to be secured in an upright position without presenting any obstruction in the channel;

an upper yoke slidable in each channel;

a lower yoke slidable in each channel;

means for releasably securing each of said yokes in any position along its respective channel;

an upper link associated with each standard, the upper link being pivoted at one end to the upper yoke;

a lower link associated with each standard, the lower link being pivoted at one end to the lower yoke;

each of the upper links being pivoted to its associated lower link at a common pivot located forwardly of the pivotal connection between the links and their respective yokes;

a table secured to the upper links for movement therewith and to connect the linkages for movement in unison with each other;

said linkages being movable between a vertial position in which the upper and lower links are in longitudinal alignment with each other and in which at least portions of the upper and lower links are received within the channels in the standards.

2. A system as defined in claim 1 wherein the depth of the table is substantially equal to the combined lengths of the links in each linkage.

3. A retractable work surface system comprising:

a pair of vertically-extending, laterally spaced elongate standards, each standard defining a longitudinal channel having a rear wall, a pair of spaced sidewalls extending forwardly from the rear wall, said channel having a forwardly facing restricted opening formed along its length and at the forward region thereof, the restricted opening being defined by a pair of flanges extending inwardly toward each other from the forward end of the sidewalls;

means enabling each standard to be secured in an upright position without presenting any obstruction in the channel;

an upper yoke slidable in each channel;

a lower yoke slidable in each channel;

means for releasably securing each of said yokes in any position along its respective channel;

an upper link associated with each standard, the upper link being pivoted at one end to the upper yoke;

a lower link associated with each standard, the lower link being pivoted at one end to the lower yoke;

the forward end of each of the upper links being pivoted to the forward end of each of the lower link at a common pivot;

a table secured to the upper liks for movement therewith and to connect the linkages for movement in unison with each other;

said linkages being moveable between a vertical position in which the upper and lower links are in longitudinal alignment with each other and in which at least portions of the upper and lower lilnks are received within the channels in the standards;

each lower yoke being formed to include an upwardly extending slot in its upper end;

said end of the lower link being pivotally received in said upwardly extending slot of the lower yoke;

each upper yoke being formed to define a downwardly extending slot in its lower end;

said end of said upper link being pivotally received within said downwardly extending slot of said upper yoke;

the means for releasably securing the yokes comprising a set screw extending through the yoke and being adapted to bear against the rear wall of each standard;

the set screw associated with the upper of the yokes including a knob which protrudes forwardly of the standards to facilitate the releasability of the upper yokes and to facilitate manual raising and lowering of the yokes.

4. A system as defined in claim 1 further comprising:

each of the upper links comprising an elongate member, angle shaped in cross section, the board being secured to one of the flanges of the angle, the other portion of the angle link being connected by said pivots to the lower link and upper yoke respectively.

5. A system as defined in claim 1 further comprising:

the combined thicknesses of the upper and lower links being no greater than the width of the slot to facilitate receiving of the links in the slot.

6. A system as defined in claim 5 further comprising stop means limiting pivotal movement of the table beyond a horizontal position.

7. A retractable work surface system comprising:

a pair of vertically-extending, laterally spaced elongate standards, each standard defining a longitudinal channel having a rear wall, a pair of spaced sidewalls extending forwardly from the rear wall, said channel having a forwardly facing restricted opening formed along its length and at the forward region thereof, the restricted opening being defined by a pair of flanges extending inwardly toward each other from the forward end of the sidewalls;

means enabling each standard to be secured in an upright position without presenting any obstruction in the channel;

an upper yoke slidable in each channel;

a lower yoke slidable in each channel;

means for releasably securing each of said yokes in any position along its respective channel;

an upper link associated with each standard, the upper link being pivoted at one end to the upper yoke;

a lower link associated with each standard, the lower link being pivoted at one end to the lower yoke;

the forward end of each of the upper links being pivoted to the forward end of each of the lower links at a common pivot;

a table secured to the upper links for movement therewith and to connect the linkages for movement in unison with each other;

said linkages being movable between a vertical position in which the upper and lower links are in longitudinal alignment with each other and in which at least portions of the upper and lower links are received within the channels in the standards;

the combined thicknesses of the upper and lower links being no greater than the width of the slot to facilitate receiving of the links in the slot;

stop means limiting pivotal movement of the table beyond a horizontal position;

wherein said stop means comprises a shoulder formed on the lower link of at least one of said linkages, the shoulder being engagable with its associated upper link when the table is in its horizontal attitude.

8. A system as defined in claim 6 wherein said stop means is carried by said upper and lower links.

* * * * *